US009826311B2

(12) United States Patent
Hansson et al.

(10) Patent No.: US 9,826,311 B2
(45) Date of Patent: Nov. 21, 2017

(54) METHOD, DEVICE AND SYSTEM FOR CONTROLLING A SOUND IMAGE IN AN AUDIO ZONE

(71) Applicant: AXIS AB, Lund (SE)

(72) Inventors: Niklas Hansson, Horby (SE); Arvid Nihlgard Lindell, Lund (SE)

(73) Assignee: Axis AB, Lund (SE)

( * ) Notice: Subject to any disclaimer, the term of this patent is extended or adjusted under 35 U.S.C. 154(b) by 0 days.

(21) Appl. No.: 15/366,283

(22) Filed: Dec. 1, 2016

(65) Prior Publication Data

US 2017/0164110 A1 Jun. 8, 2017

(30) Foreign Application Priority Data

Dec. 8, 2015 (EP) ..... 15198409

(51) Int. Cl.
*H04R 3/12* (2006.01)
*H04R 3/00* (2006.01)
*H04R 29/00* (2006.01)

(52) U.S. Cl.
CPC ..... *H04R 3/12* (2013.01); *H04R 3/005* (2013.01); *H04R 29/001* (2013.01); *H04R 2227/001* (2013.01); *H04R 2227/005* (2013.01); *H04R 2430/01* (2013.01)

(58) Field of Classification Search
CPC ..... H04M 1/19; H04R 3/12; H04R 2227/005; H04R 29/001; H04R 5/02; H04W 84/18; H04S 3/002
See application file for complete search history.

(56) References Cited

U.S. PATENT DOCUMENTS

| | | | | |
|---|---|---|---|---|
| 5,666,424 | A | 9/1997 | Fosgate et al. | |
| 7,933,421 | B2 | 4/2011 | Asada | |
| 7,968,786 | B2 | 6/2011 | Kemmochi et al. | |
| 8,126,159 | B2 | 2/2012 | Goose et al. | |
| 8,577,048 | B2 | 11/2013 | Chaikin et al. | |
| 8,995,240 | B1 * | 3/2015 | Erven | H04B 1/20 369/2 |

(Continued)

OTHER PUBLICATIONS

European Office Action dated Dec. 15, 2016 in Patent Application No. 15 198 409.3.

(Continued)

*Primary Examiner* — Mohammad Islam
(74) *Attorney, Agent, or Firm* — Oblon, McClelland, Maier & Neustadt, L.L.P.

(57) ABSTRACT

A method for adjusting an audio zone sound image in an audio system (2, 6, 7) comprising a plurality of audio zones (2A, 2B, 6A, 6B, 6C, 6D, 7A, 7B, 7C) is disclosed. Each audio zone has one or more loudspeakers (20, 21, 60, 61, 63, 64, 65, 66, 67, 68, 69, 70, 72, 73, 74, 75) located therein. The method comprises recording (101, 802) a sound image of a controlling audio zone; transmitting (102, 803) audio data corresponding to the recorded sound image to a controller; evaluating (103, 103*a*, 804) the transmitted audio data; selecting (104, 805) an adjusting audio zone, wherein the adjusting audio zone is other than the controlling audio zone; and adjusting (105, 105*a*, 105*b*, 807) an adjusting loudspeaker such that the sound image of the controlling audio zone is changed. An audio system (2, 6, 7) and a controlling loudspeaker are also disclosed.

15 Claims, 6 Drawing Sheets

(56) References Cited

U.S. PATENT DOCUMENTS

| | | | | |
|---|---|---|---|---|
| 9,355,555 | B2 * | 5/2016 | Reichert | G08C 17/02 |
| 9,524,098 | B2 * | 12/2016 | Griffiths | G06F 3/04883 |
| 2010/0329488 | A1 | 12/2010 | Holub | |
| 2012/0020486 | A1 | 1/2012 | Fried et al. | |
| 2012/0207329 | A1 | 8/2012 | Fried et al. | |
| 2013/0179163 | A1 | 7/2013 | Herbig et al. | |
| 2013/0230175 | A1 | 9/2013 | Bech et al. | |
| 2015/0063598 | A1 | 3/2015 | Shah | |
| 2015/0256954 | A1 | 9/2015 | Carlsson et al. | |

OTHER PUBLICATIONS

European Search Report (with Written Opinion) dated Jun. 8, 2016 in European Application 15198409.3 filed on Dec. 8, 2015.

* cited by examiner

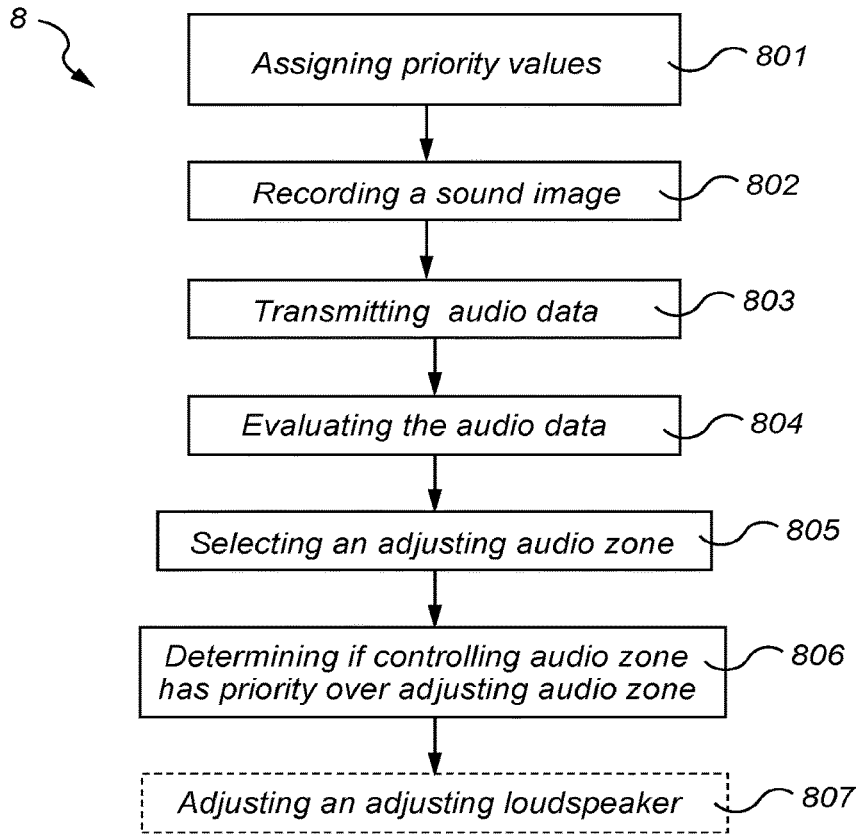
Fig. 8
Fig. 9
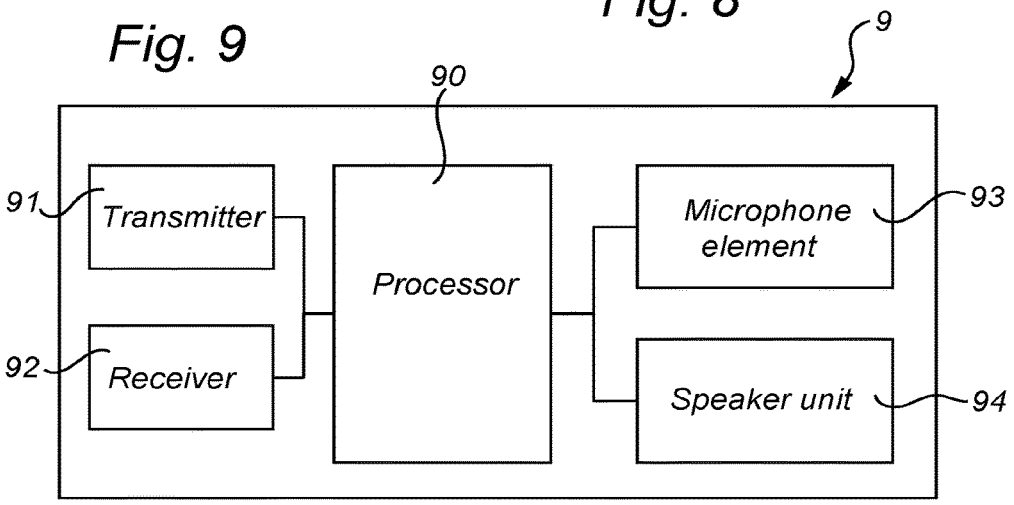

METHOD, DEVICE AND SYSTEM FOR CONTROLLING A SOUND IMAGE IN AN AUDIO ZONE

TECHNICAL FIELD

The present invention relates to a method for adjusting a sound image in one of a plurality of audio zones in an audio system. The invention also relates to an audio system and a controlling loudspeaker.

BACKGROUND OF THE INVENTION

The use of audio systems having multiple audio zones has become increasingly common. Each audio zone comprises one or more loudspeakers for providing sound to the corresponding audio zone. Different audio zones may for example cover different rooms in a building. The audio system may be used for providing sound such as music, voice messages, sound signals, etc. Audio systems are also commonly used in homes today where one or more audio zones are provided in different rooms for playing music or radio. Two or more audio zones may be grouped in order to provide the same sound in multiple audio zones. Different audio zones may of course provide different sounds as well.

When providing sound in an audio zone, it may be desired to minimize other sounds, such as sounds coming from other audio zones. U.S. Pat. No. 8,126,159 provides a solution to this problem. The disclosed audio system employs noise cancelling techniques to improve the quality of sound reception in an audio zone. However, noise cancelling techniques may be power-consuming to perform and may need to be configured in view of the current audio system.

There is thus a need for a simple method for adjustment of a sound image in an audio zone which preferably may be implemented in a wide selection of audio system with minimum need for configuration.

SUMMARY OF THE INVENTION

It is an object of the present invention to provide a method for adjusting an audio zone sound image. It is also an object to provide an audio system and a controlling loudspeaker with the same purpose.

According to a first aspect, a method for adjusting an audio zone sound image in an audio system comprising a plurality of audio zones, each audio zone having one or more loudspeakers located therein is provided. The method comprises: recording, by a microphone unit, a sound image of a controlling audio zone being one of the plurality of audio zones; transmitting audio data corresponding to the recorded sound image to a controller which is connected to the loudspeakers of each audio zone and to the microphone unit; evaluating, by the controller, the transmitted audio data; selecting, by the controller and based on the evaluation, an adjusting audio zone from the plurality of audio zones, wherein the adjusting audio zone is other than the controlling audio zone; and adjusting an adjusting loudspeaker being one of the one or more loudspeakers of the adjusting audio zone such that the sound image of the controlling audio zone is changed.

A purpose of the invention is to enable adjustment of the sound image in one of the audio zones in view of other audio zones of the same audio system. When multiple audio zones are present in an audio system, there is a risk that sound from a second audio zone is transported to, and thus heard in, a first zone. It may be desired to minimize the influence of other audio zones in the first audio zone. As exemplified above, a conventional solution to this problem is to apply noise cancelling techniques to the first audio zone which sound image is to be changed. The inventive method applies a different approach in that one or more loudspeaker(s) of the second audio zone, instead of the first audio zone, are adjusted in view of a recorded sound image of the first audio zone. By this inventive approach, a more simple method of adjusting the sound image is provided in comparison to complex noise cancellation techniques. The method may be applied without any system-specific configuration to different audio systems.

Since the audio system may automatically adjust the audio zones, a user of the system can be confident in that it is acceptable in view of the sound image of other audio zones to raise the volume level of a loudspeaker in an audio zone. Thus, the method is advantageous also from a user perspective.

The change of the sound image may be defined as an absolute change, i.e. any change in the sound image, or as a satisfactory change of the sound image, i.e. that the sound image has fulfilled one or more desired properties. For example, the sound image may be determined to have changed if a determined volume level of the sound image has decreased below a predetermined desired volume level threshold.

In one embodiment, the microphone unit comprises a plurality of microphone elements located at different positions. The evaluation of the transmitted audio data may in this embodiment comprise determining from which direction sound of the recorded sound image propagates.

By use of a plurality of microphone elements, the recorded sound image may be optimized in representing the reality.

By determining from which direction sound of the recorded sound image propagates, the selection of adjusting audio zone may be simplified. Audio zones which are not located in the direction from where the sound propagates may be disregarded in the selection of adjusting audio zone.

In one embodiment, the evaluation of the transmitted audio data comprises determining if the audio data corresponds to a sound image with a volume above a predetermined volume threshold. The adjustment is in this embodiment performed only if it is determined that the volume is above a predetermined volume threshold. The predetermined threshold may be defined as the allowed maximum volume of the controlling audio zone.

In one embodiment, the adjustment of the adjusting loudspeaker comprises decreasing the speaker volume of the adjusting loudspeaker. A condition for the decrease may be that it is determined that said speaker volume is above a predetermined speaker volume threshold.

In one embodiment, the adjustment of the adjusting loudspeaker comprises decreasing the bass volume of the adjusting loudspeaker. Bass sound typically propagates long and may be the only affecting part of the sound in the adjusting audio zone. By decreasing only the bass volume, the speaker volume, and other sound parameters, may be left unadjusted thus minimizing the required adjustment.

In one embodiment, the adjusting audio zone has a plurality of loudspeakers located therein. The method of this embodiment may further comprise increasing the speaker volume of a further adjusting loudspeaker, being another of the one or more loudspeakers. By this embodiment, the provided sound in the adjusting audio zone may be optimized in view of minimizing the influence of the provided sound on the sound image of the controlling audio zone.

In one embodiment, the adjustment of the adjusting loudspeaker comprises adjusting the adjusting loudspeaker; recording, by the microphone unit, a further sound image of the controlling audio zone; transmitting further audio data corresponding to the recorded further sound image to the controller; and evaluating, by the controller, the further audio data to determine if the sound image is changed; wherein, if the sound image is not changed, the adjustment is repeated until the sound image is changed. A purpose of this embodiment is to provide feedback to the controller for step-wise adjustment of the adjusting audio zone until a (desired) change in sound image of the controlling audio zone is achieved.

According to one embodiment, the method further comprises assigning a priority value to each audio zone, the priority value corresponding to the priority of the audio zone in relation to other audio zones in the audio system; and determining if the controlling audio zone has priority over the adjusting audio zone; wherein the adjustment of an adjusting loudspeaker is performed only if the controlling audio zone has priority over the adjusting audio zone. By this embodiment, an audio zone may be allowed or not allowed to adjust other audio zones which may beneficial in environments with audio zones which have higher importance than other, such as silent audio zones and zones for providing security sound messages.

According to a second aspect of the present invention, an audio system is provided. The audio system comprises a plurality of audio zones, each audio zone having one or more loudspeakers located therein; a microphone unit located in a controlling audio zone being one of the plurality of audio zones, wherein the microphone unit is arranged to transmit audio data corresponding to a controlling audio zone sound image recorded by the microphone unit; and a controller connected to the loudspeakers in each audio zone and to the microphone unit, the controller being arranged to: receive audio data which has been transmitted by the microphone unit; evaluate the received audio data; select, based on the evaluation, an adjusting audio zone from the plurality of audio zones, wherein the adjusting audio zone is other than the controlling audio zone; and adjust an adjusting loudspeaker being one of the one or more loudspeakers in the adjusting audio zone such that the sound image of the controlling audio zone is changed.

Above disclosed advantages of the method apply to the audio system as well. To avoid undue repetition, reference is made to the above disclosure.

In one embodiment, the selected adjusting audio zone is a neighboring audio zone to the controlling audio zone. By this embodiment, the selection may be simplified since audio zones which are not neighboring audio zones may be disregarded. This selection method is based on that it is more likely that sound in the controlling audio zone are provided by neighboring audio zone than other, more distant, audio zones.

In one embodiment, the microphone unit comprises a plurality of microphone elements which are located at different positions in the controlling audio zone. By use of a plurality of microphone elements, the recorded sound image may be optimized in representing the reality. It may also be determined from which direction the sound of the recorded sound image propagates.

In one embodiment, each audio zone is assigned a priority in relation to other audio zones within the audio system.

According to a third aspect, a controlling loudspeaker in an audio system is provided. The audio system comprises a plurality of audio zones, each audio zone having one or more loudspeakers located therein, wherein the loudspeakers are connected to each other by a network, the controlling loudspeaker comprising: a microphone unit arranged to record a sound image and to transmit audio data corresponding to the recorded sound image; and a controller arranged to: receive audio data transmitted by the microphone unit; evaluate the received audio data; select, based on the evaluation, an adjusting audio zone from the plurality of audio zones, the adjusting audio zone being other than the audio zone that the controlling loudspeaker is located within; and adjust an adjusting loudspeaker being one of the one or more loudspeakers in the adjusting audio zone such that the sound image is changed.

Above disclosed advantages of the method apply to the controlling loudspeaker as well. To avoid undue repetition, reference is made to the above disclosure.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The operations of any method disclosed herein do not have to be performed in the exact order disclosed, unless explicitly stated.

BRIEF DESCRIPTION OF DRAWINGS

The above disclosed and other aspects of the present invention will now be described in more detail, with reference to the appended drawings showing embodiments of the invention.

FIG. 8 illustrates an embodiment of a method for adjusting an audio zone sound image.

FIG. 9 illustrates an example of an operational structure of a controlling loudspeaker.

Note that figures are not to scale for purposes of clarity.

DETAILED DESCRIPTION

The present invention will now be described more fully with reference to the accompanying drawings, in which currently preferred embodiments of the invention are shown. The invention may however be embodied in many different forms and should not be construed as limited to the embodiments set forth herein.

Figure 1:
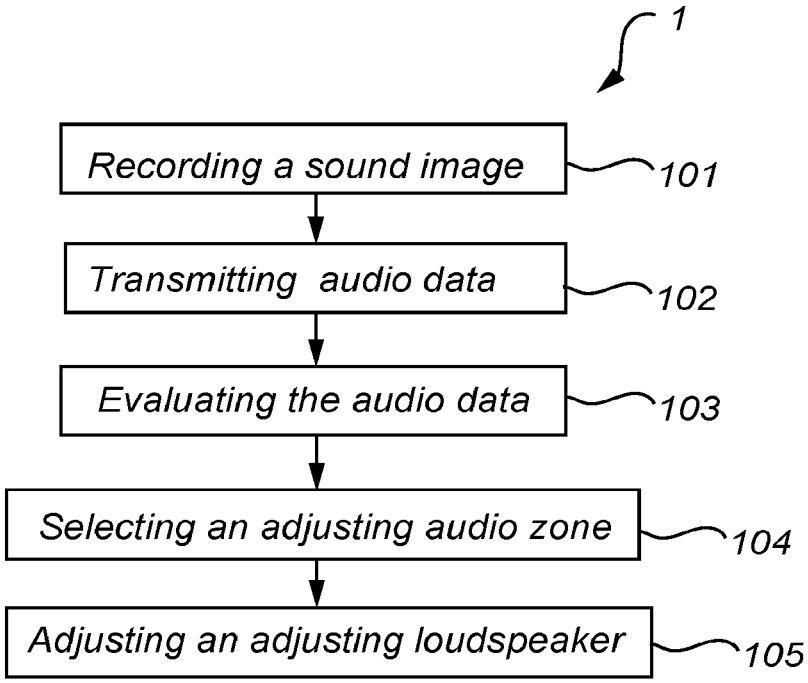
FIG. 1 illustrates a method for adjusting an audio zone sound image according to an embodiment of the invention.

A method 1 for adjusting a sound image of an audio zone according to an embodiment of the invention is illustrated in FIG. 1. The audio zone is one of a plurality of audio zones which together form an audio system. Each audio zone comprises one or more loudspeakers arranged to provide audio to a corresponding audio zone. The purpose of the method 1 is to adjust the audio system for achieving a desired sound image in one of the audio zone which is referred to as the controlling audio zone.

The method 1 comprises recording 101 a sound image of the controlling audio zone. The sound image is recorded by a microphone unit which is located within the controlling audio zone. The microphone unit comprises one or more microphone elements which may record sound independently of each other. The microphone unit may be a separate device or be a part of a loudspeaker of the controlling audio zone.

The controlling audio zone is one of the plurality of audio zones of the audio system. Each audio zone of the audio system may take the role as the controlling audio zone. In other words, the role of being the controlling audio zone is not necessarily permanent but may instead be shifted between different audio zones or may be assigned to a plurality of audio zones simultaneously. In the latter case, the methods 1 are performed in parallel within the audio system.

By sound image is meant a representation of the experience of the sound that is (or may be) heard in an audio zone. The sound image may comprise for example frequency components, information regarding volume, from where different sound propagates. The recorded sound image should be regarded as a representation of the real sound image of the audio zone.

The method 1 further comprises transmitting 102 audio data corresponding to the recorded sound image to a controller. The microphone unit, or any of the included microphone elements, transmits the audio data. The audio data represents the recorded sound image according to a conventional technique.

The controller is part of the audio system. The controller is connected to the loudspeakers of the audio system and to the microphone unit. The controller may be a separate device or be a part of one of the loudspeakers in any of the audio zones. The controller may for example be a virtual controller provided by a cloud service. The connection may be a wireless or wired connection and may be global or local.

The method 1 further comprises evaluating 103 the audio data by the controller. Examples of the evaluation 103 will be described in greater detail below.

The method 1 further comprises selecting 104 an adjusting audio zone from the plurality of audio zones. The adjusting audio zone is a different audio zone than the controlling audio zone. The selection 104 is based on the result of the evaluation 103. Different embodiment of the selection 104 will be disclosed in detail below.

The method 1 further comprises adjusting 105 an adjusting loudspeaker which is one of the loudspeaker(s) of the adjusting audio zone such that the sound image of the controlling audio zone is changed.

The change in the sound image may be defined as an absolute change, i.e. any change in the sound image, or as a satisfactory change of the sound image, i.e. that the sound image has fulfilled one or more desired properties. For example, the sound image may be determined to have changed if a determined volume level of the sound image has decreased below a predetermined desired volume level threshold.

The adjustment 105 may be applied to a plurality of adjusting loudspeaker of the adjusting audio zone. The one or more adjusting loudspeaker(s) is/are selected by the controller. Examples of parameters that may be adjusted in the loudspeaker are speaker volume and bass volume. A plurality of adjusting loudspeakers may be selected and an adjustment of parameters in the adjusting loudspeakers may be performed in relation to each other. Further embodiments of the adjustment 105 will be disclosed in detail below.

Figure 2:
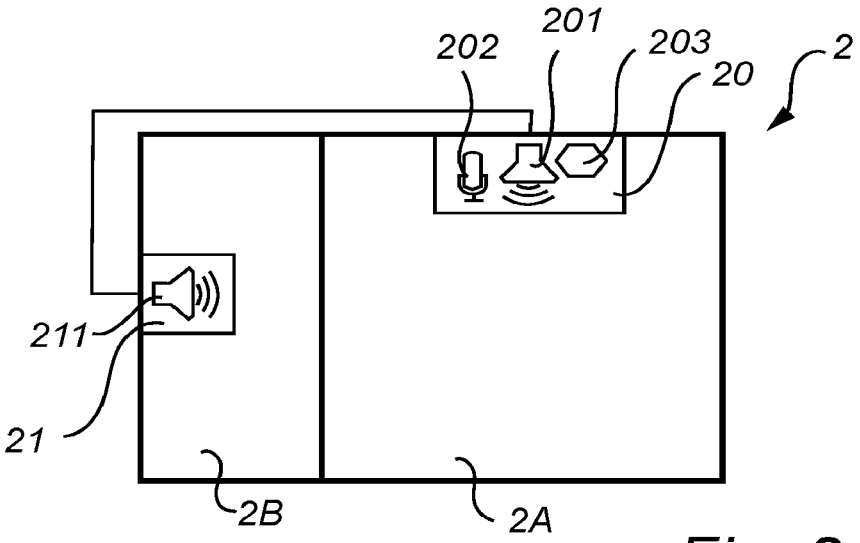
FIG. 2 illustrates an audio system comprising two audio zones.

A purpose of the invention is to enable adjustment of the sound image in one of the audio zones in view of other audio zones of the same audio system. When multiple audio zones are present in an audio system, there is a risk that sound from a second audio zone is transported to, and thus heard in, a first zone. It may be desired to minimize the influence of other audio zones in the first audio zone. As exemplified above, a conventional solution to this problem is to apply noise cancelling techniques to the first audio zone which sound image is to be changed. The inventive method applies a different approach in that one or more loudspeaker(s) of the second audio zone, instead of the first audio zone, are adjusted in view of a recorded sound image of the first audio zone. This approach will be exemplified with reference to FIG. 2 which illustrates an example of an audio system 2 to which the method 1 may be applied.

The audio system 2 comprises a first audio zone 2A and a second audio zone 2B. The first audio zone 2A comprises a first loudspeaker 20. The first loudspeaker 20 comprises a first speaker unit 201, a microphone unit 202, and a controller 203. The microphone unit 202 and/or the controller 203 may form separate devices. The second audio zone 2B comprises a second loudspeaker 21 with a second speaker unit 211. The first and second loudspeakers 20, 21 are connected to each other such that audio data may be exchanged and such that the controller 203 may adjust the second loudspeaker 21.

The first and second audio zones 2A, 2B may be located in different rooms of a building. Non-limiting examples of buildings are a private home, a school, an office space, a train station, a library, and a store.

The method 1 may be applied as follows. The microphone unit 202 records a sound image of the first audio zone 2A. The recorded sound image is represented by audio data in the microphone unit 202. The audio data is transmitted from the microphone unit 202 to the controller 203. The controller 203 evaluates the received audio data. The controller 203 selects an adjusting audio zone in the audio system 2 which in this example is the second audio zone 2B. The controller 203 adjusts an adjusting loudspeaker of the second audio zone 2B. In this example, the second loudspeaker 21 is selected as the adjusting loudspeaker and is thus adjusted. For example, the second loudspeaker 21 may be adjusted by the controller 203 by that the controller 203 requests a decrease of the speaker volume of the second loudspeaker 21. The sound image of the controlling audio zone may thereby change by that a smaller amount (or no amount) of sound which is provided in the second audio zone 2B is heard in the first audio zone 2A.

The role of controlling audio zone may be shifted between the first audio zone 2A and the second audio zone 2B. Alternatively, both the first audio zone 2A and the second audio zone 2B may simultaneously take the role as the controlling audio zone and adjust each other.

Figure 3:
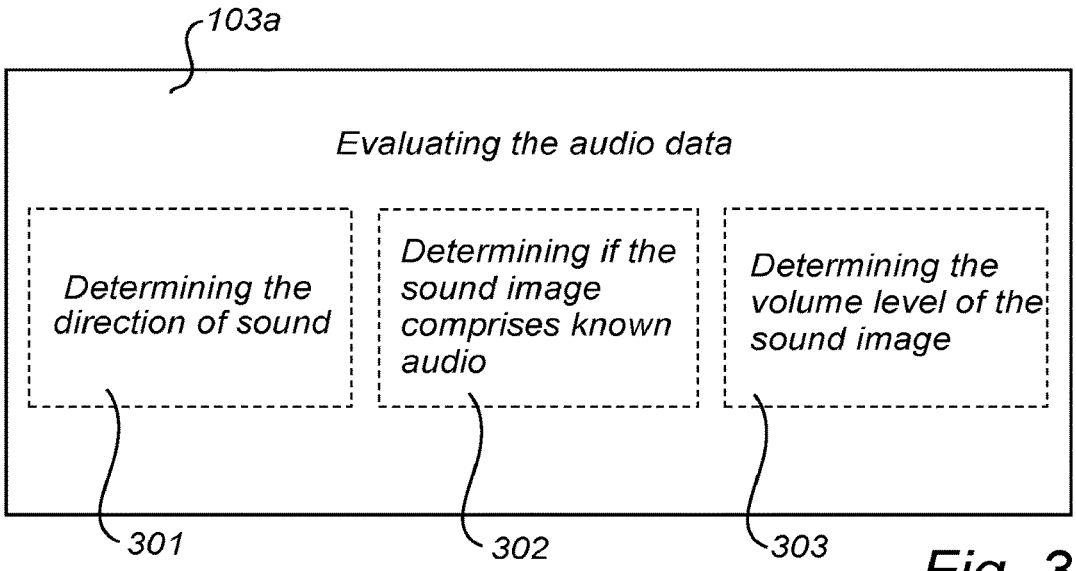
FIG. 3 illustrates different embodiments of how to evaluate audio data in the method of FIG. 1.

Different possible parts of an evaluation 103*a* of audio data, which may be part of the method 1, are illustrated in FIG. 3.

The evaluation 103*a* may comprise determining 301 the direction of sound, i.e. from which direction sound of the recorded sound image propagates. This evaluation part may be performed on audio data corresponding to a sound image which has been recorded by a microphone unit comprising a plurality of microphone elements. The microphone elements are located at different positions in the controlling audio zone. The direction of sound may be determined 301 by for example evaluating the time difference between the recordings of the same sound element by different microphone elements. For example, if a sound element is recorded by a first microphone element before being recorded by a second microphone element, it may be determined that the sound propagates in a direction from the first microphone element towards the second microphone element. In other words, it may be determined that the audio source from which the sound propagates is located nearer the first microphone element than the second microphone element. This information may aid the controller in selecting an adjusting audio zone. For example, audio zones which are located nearer the second microphone may be disregarded in the selection.

The evaluation 103*a* may alternatively, or in addition, comprise determining 302 if the sound image comprises known audio. This evaluation component may be implemented in an audio system in which the controller has access to data pertaining to which audio that is provided in each audio zone. The controller may thereby compare the received audio data with audio data corresponding to audio which has been provided around the same time by audio zones other than the controlling audio zone. The comparison may for example be performed by performing a frequency analysis of the recorded sound and compare the result of that analysis with the result of a corresponding frequency analysis of sound which has been provided in other audio zone around the same time. The controller may take into account the time difference for the sound to propagate from the other audio zone to the controlling audio zone.

If the controller determines that received audio data do not match audio data corresponding to audio provided in another audio zone, that particular other audio zone may be disregarded for the selection of the adjusting audio zone. Correspondingly, if the controller determines that the received audio data matches audio data corresponding to audio provided in another audio zone, that particular other audio zone may be selected as the adjusting audio zone.

The evaluation 103*a* may alternatively, or in addition, comprise determining 303 the volume level of the sound image. In other words, the controller may evaluate the received audio data to determine the volume level of the corresponding sound image. The controller may further determine if the volume is above a predetermined volume threshold. The predetermined volume threshold may be defined as the allowed maximum volume of a room. If the volume is above the predetermined volume threshold, the controller may try to adjust the sound image by adjustment of adjusting loudspeakers in other audio zones. When the volume threshold has been reached, i.e. if the volume is below the predetermined volume threshold, the controller may decide that no adjustment is to be made.

Figure 4:
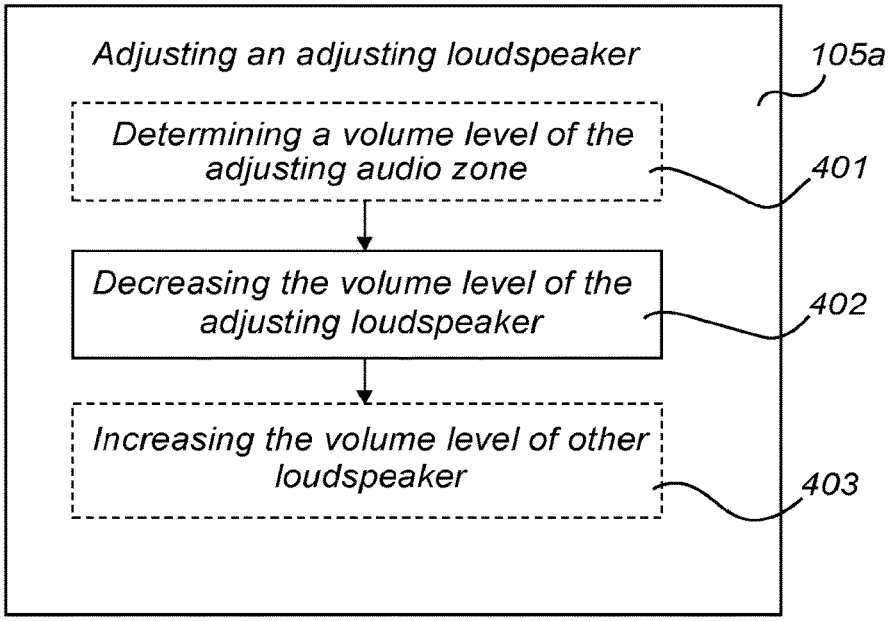
FIG. 4 and FIG. 5 illustrate embodiments of how to adjust the adjusting loudspeaker in the method of FIG. 1.

An embodiment of how an adjustment 105*a* of an adjusting loudspeaker, which may be part of the method 1, may be performed is illustrated in FIG. 4. The adjustment 105*a* comprises decreasing 402 the volume level of the adjusting loudspeaker. The volume level may correspond to the speaker volume level or to the bass volume level or to a combination of both.

The adjustment 105*a* may optionally comprise a preceding step of determining 401 the volume level of the adjusting audio zone. The determined volume level of the adjusting audio zone may be compared to a predetermined volume level threshold. The decrease 402 of the volume level of the adjusting loudspeaker may be performed on a condition that the determined volume level of the adjusting audio zone is above the predetermined volume level threshold. By this condition, it is assured that the controlling audio zone is not allowed to mute the adjusting audio zone.

The adjustment 105*a* may optionally comprise increasing 403 the volume level of one or more loudspeaker(s) in the adjusting audio zone being other than the adjusting loudspeaker. By this function, the combined volume level in the adjusting audio zone may be partly or fully remained. For example, the controller may decrease a volume level of an adjusting loudspeaker being situated nearest, among the loudspeakers of the adjusting audio zone, the controlling audio zone. The controller may at the same time increase the volume level of one or more other loudspeakers in the adjusting audio zone, which thus is/are located farther away from the controlling audio zone.

Figure 5:
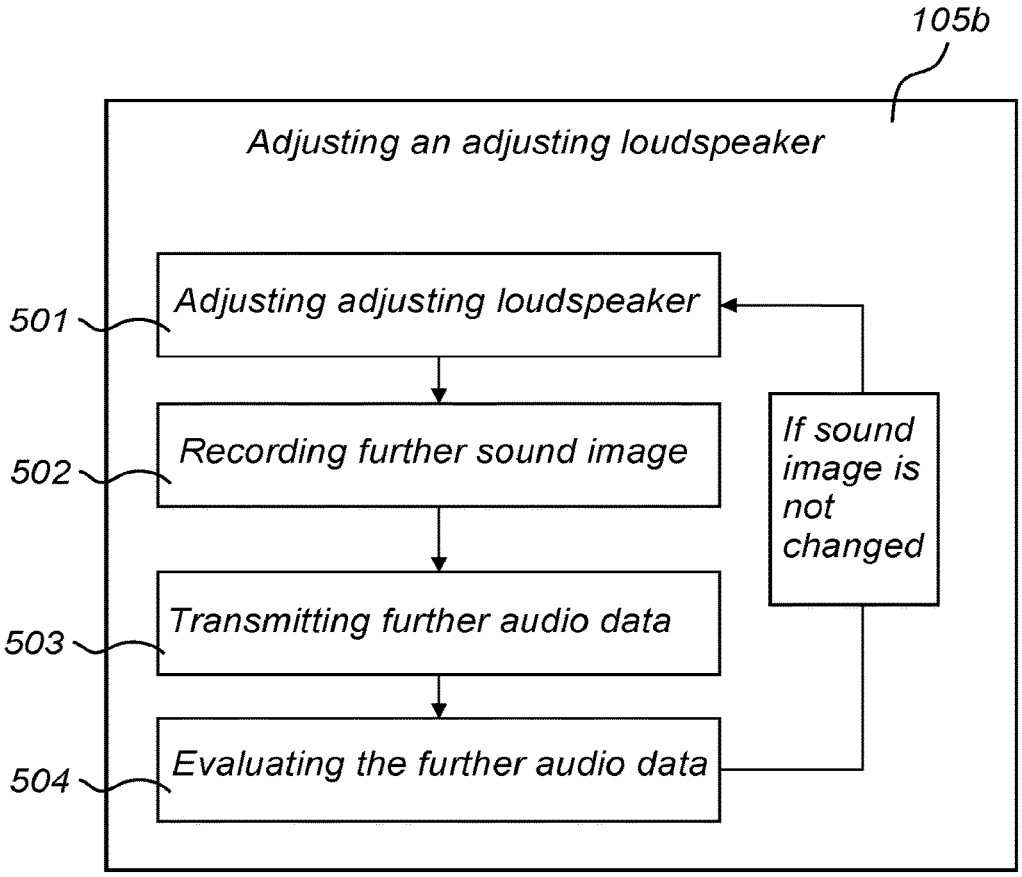

Another embodiment of how an adjustment 105*b* of an adjusting loudspeaker, which may be part of the method 1, may be performed is illustrated in FIG. 5. The purpose of this embodiment is to provide feedback to the controller for step-wise adjustment of the adjusting audio zone until a changed sound image of the controlling audio zone is achieved.

The adjustment 105*b* comprises adjusting 501 an adjusting loudspeaker which may be performed according to above disclosed examples. The adjustment 105*b* further comprises recording 502 a further sound image of the controlling audio zone. The further sound image is recorded by the microphone unit of the controlling audio zone. The adjustment 105*b* further comprises transmitting 503 further audio data corresponding to the recorded further sound image. The audio data is transmitted from the microphone unit to the controller. The adjustment 105*b* further comprises evaluating 504, by the controller, the further audio data to determine if the sound image has changed. The further audio data is compared to previously recorded sound data. If it is determined that the sound image has not changed, the adjustment is repeated until the sound image has changed. In other words, the adjustment 501 of an adjusting loudspeaker, the recording 502 of a further sound image, the transmitting 503 of further audio data, and the evaluation 504 of the further audio data are repeated in an iteration.

The evaluation 504 may comprise a comparison of the further audio data with audio data recorded in the preceding iteration or with audio data recorded in a specific iteration such as the first iteration.

As disclosed above, what is meant by that the sound image has changed may have different definition depending on the embodiment. Change may be defined as an absolute change, i.e. that the audio data corresponding to the sound image has changed in any way. Change may alternatively be defined as a particular change in the sound image. Non-limiting examples of particular changes are a change of one or more specific frequencies of the sound or a decrease, optionally below a certain volume threshold, of a volume level such as a bass volume level. In order to evaluate if the sound image has changed, the evaluation 504 may comprise performing a frequency analysis of audio data corresponding to the recorded sound images and compare if the sound component of one or more frequencies have changed between a previous recorded sound image and a recorded further sound image.

Accordingly, how the evaluation 504 is performed depends on the desired change in the sound image which may be defined differently for different audio systems implementing the method.

By use of the iterated feedback method exemplified in FIG. 5, different adjustments, such as decreasing bass volume or decreasing speaker volume, may be evaluated in different iteration in order to achieve a change in the sound image.

Figure 6:
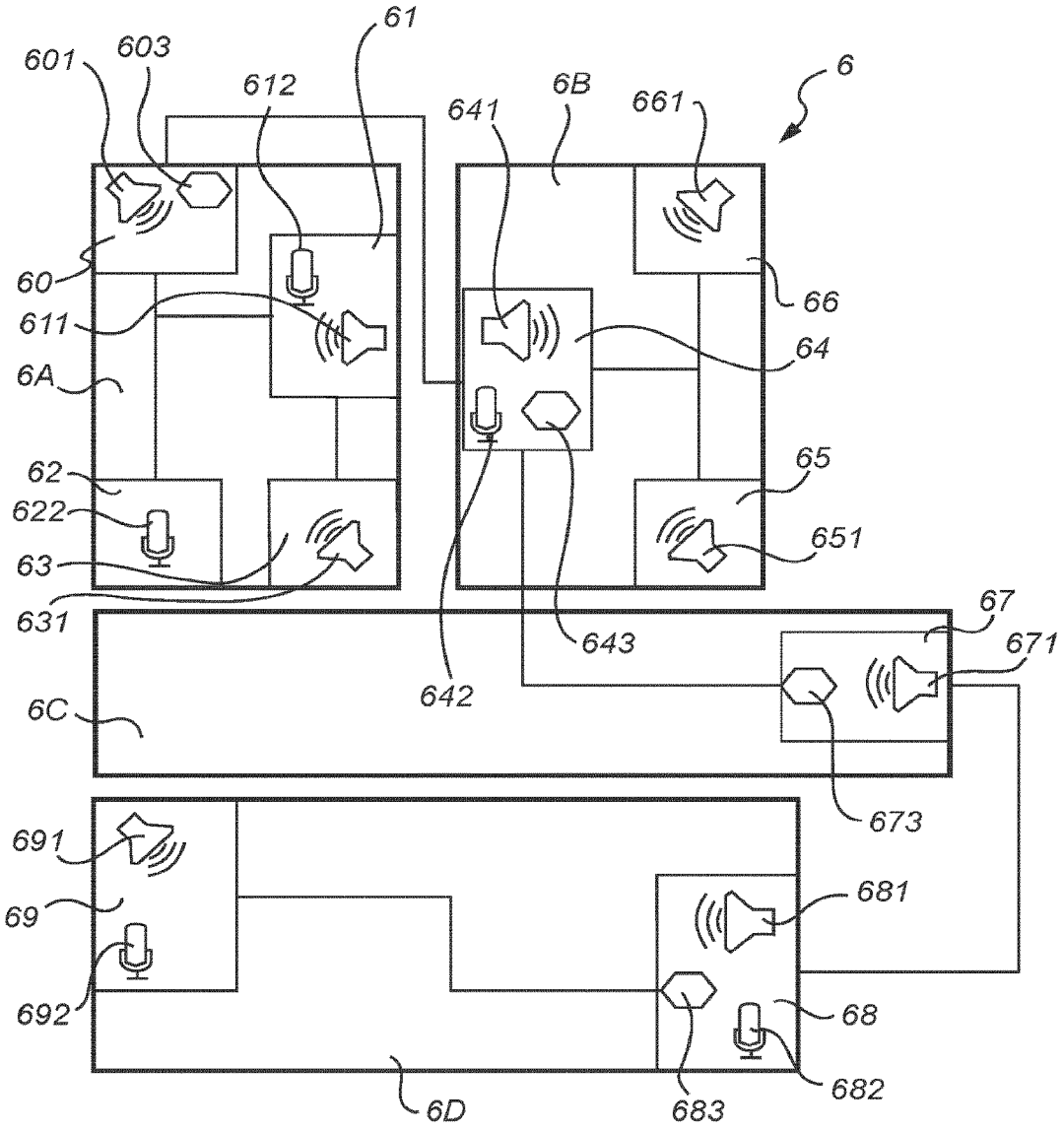
FIG. 6 illustrates an audio system comprising four audio zones.

Another example of an audio system 6 according to an embodiment of the invention is illustrated in FIG. 6. The audio system 6 comprises four audio zones 6A, 6B, 6C, 6D which each covers a room in a building.

The first audio zone 6A comprises a first loudspeaker 60, a second loudspeaker 61, and a third loudspeaker 63. The first loudspeaker 60 of the first audio zone 6A comprises a speaker unit 601 and a controller 603. The second loudspeaker 61 of the first audio zone 6A comprises a speaker unit 611 and a microphone element 612. The third loudspeaker 63 of the first audio zone 6A comprises a speaker unit 631. The first audio zone 6A also comprises a microphone device 62 having a microphone element 622. The loudspeakers 60, 61, 63 and the microphone device 62 are connected to each other.

The second audio zone 6B comprises a first loudspeaker 64, a second loudspeaker 65, and a third loudspeaker 66. The first loudspeaker 64 of the second audio zone 6B comprises a speaker unit 641, a microphone element 642, and a controller 643. The second loudspeaker 65 of the second audio zone 6B comprises a speaker unit 651. The third loudspeaker 66 of the second audio zone 6B comprises a speaker unit 661. The loudspeakers 64, 65, 66 are connected to each other.

The third audio zone 6C comprises a first loudspeaker 67 which has a speaker unit 671 and a controller 673.

The fourth audio zone 6D comprises a first loudspeaker 68 and a second loudspeaker 69. The first loudspeaker 68 of the fourth audio zone 6D comprises a speaker unit 681, a microphone element 682, and a controller 683. The second loudspeaker 69 of the fourth audio zone 6D comprises a speaker unit 691 and a microphone element 692. The first loudspeaker 68 and the second loudspeaker 69 of the fourth audio zone 6D are connected to each other.

The audio zones 6A, 6B, 6C, 6D are connected to each other such that data may be exchanged between the audio zones.

FIG. 6 illustrates different sub-configurations of the audio system 6 which are possible within the scope of the invention and which will be exemplified in the following.

As can be seen in the first audio zone 6A, the microphone element 622 is part of the microphone device 62 which is not a loudspeaker. Thus, a microphone element of a microphone unit may be arranged separately from the loudspeakers of the audio zone.

The microphone unit of the first audio zone 6A comprises two microphone elements 612, 622. The microphone unit may thus be formed by partly a separate microphone element and partly of a microphone element being part of a loudspeaker of the audio zone.

It is also noted that an audio zone may not comprise a microphone unit, as is the case with the third audio zone 6C of the audio system 6.

The audio system 6 comprises several controllers 603, 643, 673, 683. Thus, the audio system may comprise a plurality of controllers. Each audio zone 6A, 6B, 6C, 6D comprises a controller 603, 643, 673, 683. The audio system 6 may be configured such that each controller 603, 643, 673, 683 may be arranged to adjust loudspeakers in other audio zones of the audio system 6 according to the inventive method. Alternatively, one controller may be appointed (temporarily or permanently) to adjust loudspeakers in other audio zones of the audio system 6 according to the inventive method. For example, the controller 643 of the second audio zone 6B may be allowed to adjust some or all of the loudspeakers in the other audio zones 6A, 6C, 6D.

In other words, the location of the controller which controls the loudspeakers within the audio system is not important. The controller may be located within one of the audio zones of the audio system, or may be arranged outside the audio zones such as a part of a cloud service.

Different scenarios of how the inventive method may be executed will now be disclosed with reference to the audio system 6 of FIG. 6.

In a first scenario, the first audio zone 6A is a controlling audio zone. The sound image of the first audio zone 6A is recorded by the microphone unit comprising the microphone elements 612, 622 of the first audio zone 6A. Audio data corresponding to the recorded sound image is transmitted to the controller 603 of the first audio zone 6A. The controller 603 evaluates the transmitted audio data. The evaluation may be performed according to above disclosed examples. For example, the evaluation may comprise determining from which direction sound of the recorded sound image propagates. The controller 603 selects an adjusting audio zone from the plurality of other audio zones 6B, 6C, 6D. The selection may comprise disregarding audio zones which are not neighboring audio zones. In other words, the audio zone 6D may be disregarded and the controller selects one of the second audio zone 6B and the third audio zone 6C as the adjusting audio zone. By disregarding audio zones which are not neighboring audio zones, the selection of adjusting audio zone may be simplified. This selection method is based on that it is more likely that sound in the controlling audio zone are provided by neighboring audio zone than other, more distant, audio zones.

In an example where the controller 603 has determined that the sound propagates in a direction from the microphone element 622 of the microphone device 62 towards the microphone element 612 of the second loudspeaker 61, the controller 603 may choose the third audio zone 6C as the adjusting audio zone since the sound propagates from this direction. The controller 603 may adjust the loudspeaker 67 of the third audio zone 6C such that the sound image of the first audio zone 6A is changed.

In an alternative example, the controller 603 may have access to data pertaining to which audio that is provided in one or more of the other audio zones 6B, 6C, 6D. The evaluation of the recorded sound may then comprise determining if the recorded sound corresponds to any sound that the controller 603 knows has been provided at (essentially) the same time by any of the other audio zones. If a match is found, the corresponding other audio zone may be chosen as the adjusting audio zone. As an example, frequency analysis of the different sounds may be used for performing the comparison.

It is noted that parts of the above disclosed examples may be combined. For example, the evaluation of audio data by the controller 603 may comprise both determining from which direction the sound propagates and determining if the sound is provided by any of the other audio zones. This combination may be useful if for example similar sound is provided by the second audio zone 6B and the fourth audio zone 6D. Firstly, the controller 603 may disregard the third audio zone 6C in the selection of the adjusting audio zone since the third audio zone 6C does not provide the sound received in the first audio zone 6A. Secondly, the controller 603 may select the fourth audio zone 6D as the adjusting audio zone if it is determined that the sound propagates in a direction from the fourth audio zone 6D.

In a second scenario, the second audio zone 6B is a controlling audio zone. A sound image of the second audio zone 6B is recorded and audio data corresponding to the sound image is transmitted to the controller 643 of the second audio zone 6B. The controller 643 evaluates the audio data and selects, based on the evaluation, an adjusting audio zone. For example, the controller 643 selects the first audio zone 6A as the adjusting audio zone. The controller 643 may choose the second loudspeaker 61 and the third loudspeaker 63 of the first audio zone 6A as an adjusting loudspeaker based on that these loudspeakers are located nearest the controlling audio zone, i.e. the second audio zone 6B. The controller 643 may adjust the adjusting loudspeakers 61, 63 by decreasing the speaker and/or bass volume of the adjusting loudspeakers 61, 63. The controller 643 may also increase the speaker and/or bass volume of the first loudspeaker 60 of the first audio zone 6A in order to compensate for the decrease. This is an example of how the provided sound in the adjusting audio zone may be optimized in order to minimize the influence of the provided sound on the sound image of the controlling audio zone.

It is noted that even though the examples above discloses that the controller of the controlling audio zone performs the adjustment of the sound image, it is also feasible that a controller outside the controlling audio zone, such as one in another audio zone of the audio system, performs the adjustment. Even the controller of the adjusting audio zone may perform the adjustment. It is also noted that even though it the examples discloses that the adjustment is performed by a single controller, different controllers may perform different operations of the method and are thus together regarded as a single common controller.

Figure 7:
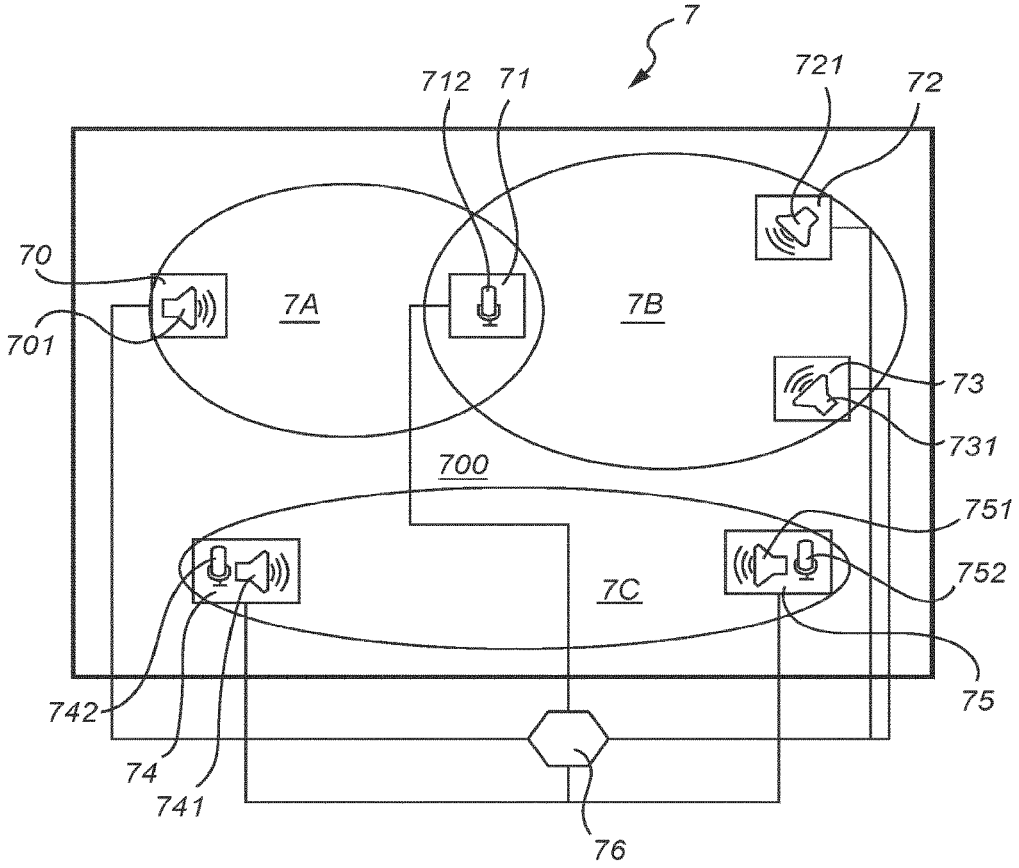
FIG. 7 illustrates an audio system comprising three audio zones in a single room.

FIG. 7 illustrates an embodiment of an audio system 7 which is provided in a room 700. The audio system 7 comprises a first audio zone 7A, a second audio zone 7B and a third audio zone 7C. The first audio zone 7A comprises a loudspeaker 70 having a speaker unit 701. The second audio zone 7B comprises a first loudspeaker 72 having a speaker unit 721, and a second loudspeaker 73 having a speaker unit 731. The third audio zone 7C comprises a first loudspeaker 74 and a second loudspeaker 75. Each of the loudspeaker 74, 75 comprises a speaker unit 741, 751 and a microphone element 742, 752. The audio system 7 also comprises a microphone device 71 having a microphone element 712.

The loudspeakers 70, 72, 73, 74, 75 and the microphone device 71 are connected to a controller 76. The controller 76 is located outside the room 700. The controller 76 is common for all loudspeakers and microphone units of the audio system 7.

The audio system 7 exemplifies that different audio zones of an audio system according to the invention may be provided in a single room. The audio zones may overlap, as is the case with the first audio zone 7A and the second audio zone 7B, or may be separate from other audio zones, as is the case with the third audio zone 7C.

The audio system 7 also exemplifies that a microphone unit or microphone element may be part of a plurality of zones, as is the case with the microphone element 712 of the microphone device 71. This microphone element 712 may record a sound image of either or both of the first audio zone 7A and second audio zone 7B.

FIG. 8 illustrates a method 8 which may be included as a part of the method for adjusting an audio zone. The method 8 is based on the method 1 exemplified in FIG. 1. The parts of recording 802, transmitting 803, evaluating 804 and selecting 805 are disclosed above in connection to corresponding parts of the method 1. The parts will thus not be explained in detail again.

The method 8 comprises assigning 801 a priority value to each audio zone in an audio system. The assigning 801 may be performed before recording 802 a sound image. After selecting 805 an adjusting audio zone, the method 8 comprises determining 806 if the controlling audio zone has priority over the adjusting audio zone. Based on the result of the determination 806, the adjustment 807 of the adjusting loudspeaker is performed. In other words, if the controlling audio zone does not have priority over the adjusting audio zone, the adjustment 807 is not allowed. By this condition, an audio zone may be allowed or not allowed to adjust other audio zones.

For example, an audio zone which covers an area which is intended to be quiet may be assigned highest priority, meaning that it is allowed to adjust any other audio zone in the audio system. Thus, the volume level of the sound image in that audio zone may be kept to a minimum with regards to sound provided by other audio zones in the audio system.

As another example, an audio zone which is intended to be used for important sound messages, such as warning signals or security messages, may be assigned highest priority whereby other audio zones of the audio system is not allowed to lower its volume level.

The priority values may be assigned according to conventional methods. One example is to assign the audio zones different numerical values corresponding to the priority, for example a number between 1-5 where 1 corresponds to highest priority and 5 corresponds to lowest priority.

FIG. 9 illustrates a controlling loudspeaker 9. The controlling loudspeaker 9 may be arranged in an audio system according to the invention, for example any of the exemplified audio systems above.

The controlling loudspeaker 9 comprises a microphone element 93 which is part of a microphone unit. The microphone element 93 is arranged to record a sound image and to transmit audio data corresponding to the recorded sound image. The audio data is received by a processor 90 which may function as a controller. The processor 90 is arranged to evaluate the received audio data, to select an adjusting audio zone and to adjust an adjusting loudspeaker of the one or more loudspeakers in the adjusting audio zone. Examples of these functions have been disclosed above in connection to previous embodiments.

The controlling loudspeaker 9 also comprises a speaker unit 94 for providing audio to an audio zone in which the controlling loudspeaker 9 is located.

The controlling loudspeaker 9 also comprises a transmitter 91 and a receiver 92 for transmitting and receiving data to and from connected devices, such as other loudspeakers of the audio system. The transmitter 91 may be used for sending data pertaining to the adjustment of the adjusting loudspeaker. The receiver 92 may be used for receiving audio data from other microphone elements which are comprised in the microphone unit.

The person skilled in the art realizes that the present invention by no means is limited to the preferred embodiments described above. On the contrary, many modifications and variations are possible within the scope of the appended claims. For example, the method may be applied to an audio system comprising loudspeakers in the form of cameras each comprising speaker unit.

The invention claimed is:

1. A method for adjusting an audio zone sound image in an audio system comprising a plurality of audio zones, each audio zone having one or more loudspeakers located therein, the method comprising:

recording, by a microphone unit, a sound image of a controlling audio zone being one of the plurality of audio zones;

transmitting audio data corresponding to the recorded sound image to a controller which is connected to the loudspeakers of each audio zone and to the microphone unit;

evaluating, by the controller, the transmitted audio data;

selecting, by the controller and based on the evaluation, an adjusting audio zone from the plurality of audio zones, wherein the adjusting audio zone is other than the controlling audio zone; and adjusting an adjusting loudspeaker being one of the one or more loudspeakers of the adjusting audio zone such that the sound image of the controlling audio zone is changed.

2. The method according to claim 1, wherein the microphone unit comprises a plurality of microphone elements located at different positions, and wherein the evaluation of the transmitted audio data comprises determining from which direction sound of the recorded sound image propagates.

3. The method according to claim 1, wherein the evaluation of the transmitted audio data comprises:

determining if the audio data corresponds to a sound image with a volume above a predetermined volume threshold;

wherein the adjustment is performed only if it is determined that the volume is above a predetermined volume threshold.

4. The method according to claim 1, wherein the controller has access to data pertaining to which audio that is provided in each audio zone, and wherein the evaluation of the transmitted audio data comprises determining if the sound image comprises audio provided by any one of the audio zones other than the controlling audio zone.

5. The method according to claim 1, wherein the adjustment of the adjusting loudspeaker comprises decreasing the speaker volume of the adjusting loudspeaker.

6. The method according to claim 5, wherein the speaker volume is decreased only if said speaker volume is above a predetermined speaker volume threshold.

7. The method according to claim 1, wherein the adjustment of the adjusting loudspeaker comprises decreasing the bass volume of the adjusting loudspeaker.

8. The method according to claim 5, wherein the adjusting audio zone has a plurality of loudspeakers located therein, and wherein the method further comprises:

increasing the speaker volume of a further adjusting loudspeaker, being another of the one or more loudspeakers.

9. The method according to claim 1, wherein the adjustment of the adjusting loudspeaker comprises:

adjusting the adjusting loudspeaker;

recording, by the microphone unit, a further sound image of the controlling audio zone;

transmitting further audio data corresponding to the recorded further sound image to the controller; and evaluating, by the controller, the further audio data to determine if the sound image is changed;

wherein, if the sound image is not changed, the adjustment is repeated until the sound image is changed.

10. The method according to claim 1, further comprising:

assigning a priority value to each audio zone, the priority value corresponding to the priority of the audio zone in relation to other audio zones in the audio system; and determining if the controlling audio zone has priority over the adjusting audio zone;

wherein the adjustment of an adjusting loudspeaker is performed only if the controlling audio zone has priority over the adjusting audio zone.

11. An audio system comprising:

a plurality of audio zones, each audio zone having one or more loudspeakers located therein;

a microphone unit located in a controlling audio zone being one of the plurality of audio zones, wherein the microphone unit is arranged to transmit audio data corresponding to a controlling audio zone sound image recorded by the microphone unit; and a controller connected to the loudspeakers in each audio zone and to the microphone unit, the controller being arranged to:

receive audio data which has been transmitted by the microphone unit;

evaluate the received audio data;

select, based on the evaluation, an adjusting audio zone from the plurality of audio zones, wherein the adjusting audio zone is other than the controlling audio zone; and adjust an adjusting loudspeaker being one of the one or more loudspeakers in the adjusting audio zone such that the sound image of the controlling audio zone is changed.

12. The audio system according to claim 11, wherein the selected adjusting audio zone is a neighboring audio zone to the controlling audio zone.

13. The audio system according to claim 11, wherein the microphone unit comprises a plurality of microphone elements which are located at different positions in the controlling audio zone.

14. The audio system according to claim 11, wherein each audio zone is assigned a priority in relation to other audio zones within the audio system.

15. A controlling loudspeaker in an audio system comprising a plurality of audio zones, each audio zone having one or more loudspeakers located therein, wherein the loudspeakers are connected to each other by a network, the controlling loudspeaker comprising:

a microphone unit arranged to record a sound image and to transmit audio data corresponding to the recorded sound image; and a controller arranged to:

receive audio data transmitted by the microphone unit;

evaluate the received audio data;

select, based on the evaluation, an adjusting audio zone from the plurality of audio zones, the adjusting audio zone being other than the audio zone that the controlling loudspeaker is located within; and adjust an adjusting loudspeaker being one of the one or more loudspeakers in the adjusting audio zone such that the sound image is changed.

* * * * *